US005386739A

United States Patent [19]

Serrano et al.

[11] Patent Number: 5,386,739

[45] Date of Patent: Feb. 7, 1995

[54] RETURN DEVICE FOR A STARTER HEAD FOR AN INTERNAL COMBUSTION ENGINE

[75] Inventors: Jean-Francois Serrano, Saint Priest; Viviane Bonin, Villefontaine, both of France

[73] Assignee: VALEO Equipments Electriques Moteur, Creteil, France

[21] Appl. No.: 19,087

[22] Filed: Feb. 18, 1993

[30] Foreign Application Priority Data

Feb. 20, 1992 [FR] France ..... 92 01924

[51] Int. Cl.[6] ..... F02N 15/06

[52] U.S. Cl. ..... 74/7 A; 74/7 C; 403/375

[58] Field of Search ..... 74/7 R, 7 A, 7 C; 192/42, 45, 98, 99 A; 403/254, 327, 375 R

[56] References Cited

U.S. PATENT DOCUMENTS

| | | | |
|---|---|---|---|
| 2,968,503 | 1/1961 | Ferrara et al. | 403/375 |
| 4,574,648 | 3/1986 | Debello | 74/7 A |
| 4,855,610 | 8/1989 | Morishita et al. | 74/7 A X |
| 4,883,152 | 11/1989 | Froment | 142/42 |
| 5,267,807 | 12/1993 | Biedermann et al. | 403/375 |

FOREIGN PATENT DOCUMENTS

| | | | |
|---|---|---|---|
| 2064768A | 7/1971 | France . | |
| 2145116A | 2/1973 | France . | |
| 3118326 | 4/1982 | Germany . | |
| 128565 | 6/1950 | Switzerland | 403/DIG. 7 |
| 1395349A | 5/1975 | United Kingdom . | |

*Primary Examiner*—Allan D. Herrmann
*Attorney, Agent, or Firm*—Morgan & Finnegan

[57] ABSTRACT

A starter head for an internal combustion engine that has a motor shaft and a starter pinion which is arranged for sliding movement along the motor shaft. A fastening shroud secures a free wheel and a drive sleeve to the starter pinion. The drive sleeve carries a return device, which has a ring member having at its inner periphery a plurality of resiliently deformable teeth. These teeth cooperate, in snap-fitting engagement, with a groove which is formed on the outer periphery of an end portion of the drive sleeve.

8 Claims, 2 Drawing Sheets

RETURN DEVICE FOR A STARTER HEAD FOR AN INTERNAL COMBUSTION ENGINE

FIELD OF THE INVENTION

The present invention relates to starter heads for internal combustion engines, in which the starter head includes a return device: more particularly the invention is concerned with such a return device.

BACKGROUND OF THE INVENTION

A starter head for an internal combustion engine conventionally comprises a starter pinion which is arranged to be displaced axially on a motor shaft until it comes into engagement with a toothed crown fitted around the engine flywheel. A free wheel and a drive sleeve are associated with the starter pinion, to which they are secured by means of a fastening shroud.

The drive sleeve has at one of its ends a set of helical splines, which cooperate with helical splines formed on the engine shaft so as to couple the starter head assembly to the motor shaft, for rotation together with the latter. Displacement of the starter head from its rest position to its working position, in which the starter pinion is meshed with the toothed crown on the flywheel, is effected by pivoting action of an actuating lever which is controlled in a known manner by an electro-magnet which also constitutes a contactor.

When the engine has started, the starter head must be returned to its rest position. This movement is effected by pivoting of the actuating lever in the reverse direction, this being initiated by the return spring of the contactor and the cooperation of the said lever with a return device which is secured to the starter head. Most commonly, this return device is arranged on the drive sleeve of the starter head.

In the case where the drive sleeve is made by matching a metal bar, the return device comprises an integral sleeve, so that the assembly is in monobloc form, as, for instance, is disclosed in the specification of French published patent application No. FR 2 145 116A. Although an arrangement of this kind is satisfactory in terms of mechanical reliability, its manufacture necessitates additional machining operations, which increase the cost of the starter as a whole in a somewhat prohibitive manner.

Alternatively, the drive sleeve may be made by extrusion, in which case the return device has to be mounted on it, and must thus consist of components which are separate from the drive sleeve itself.

In order to fulfil this function, proposals have been put forward to make the return device in the form of a movable pulley. This movable pulley may comprise two pressed rings which are separated by a spacing ring, one of the pressed rings being held against translational movement by a cotter pin. Such an arrangement, which is disclosed for example in the specification of French published patent application No. FR 2 064 768A, not only calls for a substantial number of components, but is a complex assembly which is not suitable for the kind of quality production that prevails in the automotive industry.

It has also been proposed to replace the movable pulley arrangement with an immovable pulley, which is prevented by a cotter pin from performing any translational movement. This arrangement is disclosed in the specification of French published patent application No. FR 2 615 568A. Such an arrangement calls for a stepped groove to be machined in the drive sleeve. Apart from the additional cost involved in machining and assembly, the ring is unable to be prevented from rotating, and this inevitably gives rise to noise problems while the starter is operating.

Replacement of the ring and its associated cotter pin, by means of a ring which cannot be lost in a groove, in no way resolves the noise problems mentioned above. Such a ring is initially of a conical shape, and is then fitted in the groove, in which it is realigned so that it becomes flat. To prevent it from escaping, this necessitates heat treatment of the ring with the drive sleeve.

DISCUSSION OF THE INVENTION

An object of the present invention is to overcome the above mentioned problems.

To this end, according to the invention, a return device, for an internal combustion engine starter head consisting principally of a motor shaft on which a starter pinion is able to slide, the starter pinion being secured by means of a shroud to a free wheel and a drive sleeve, is characterised in that it consists of a ring member having at its inner periphery a plurality of resiliently deformable teeth which cooperate in snap-fitting engagement with a groove formed on the outer periphery of an end portion of the drive sleeve.

According to a preferred feature of the invention, the teeth define an angle of inclination with respect to the axis of the ring member.

According to another preferred feature of the invention, the groove in the drive sleeve defines, with respect to the axis of the latter, a second angle of inclination which is smaller than the angle of inclination of the teeth.

According to a further preferred feature of the invention, the angle of inclination of the groove is substantially equal to one half of the angle of inclination of the teeth.

Further features and advantages of the invention will appear more clearly from the description of a preferred embodiment of the invention, which follows and which is given by way of example only and with reference to the accompanying drawings.

DESCRIPTION OF A PREFERRED EMBODIMENT OF THE INVENTION

Figure 1:
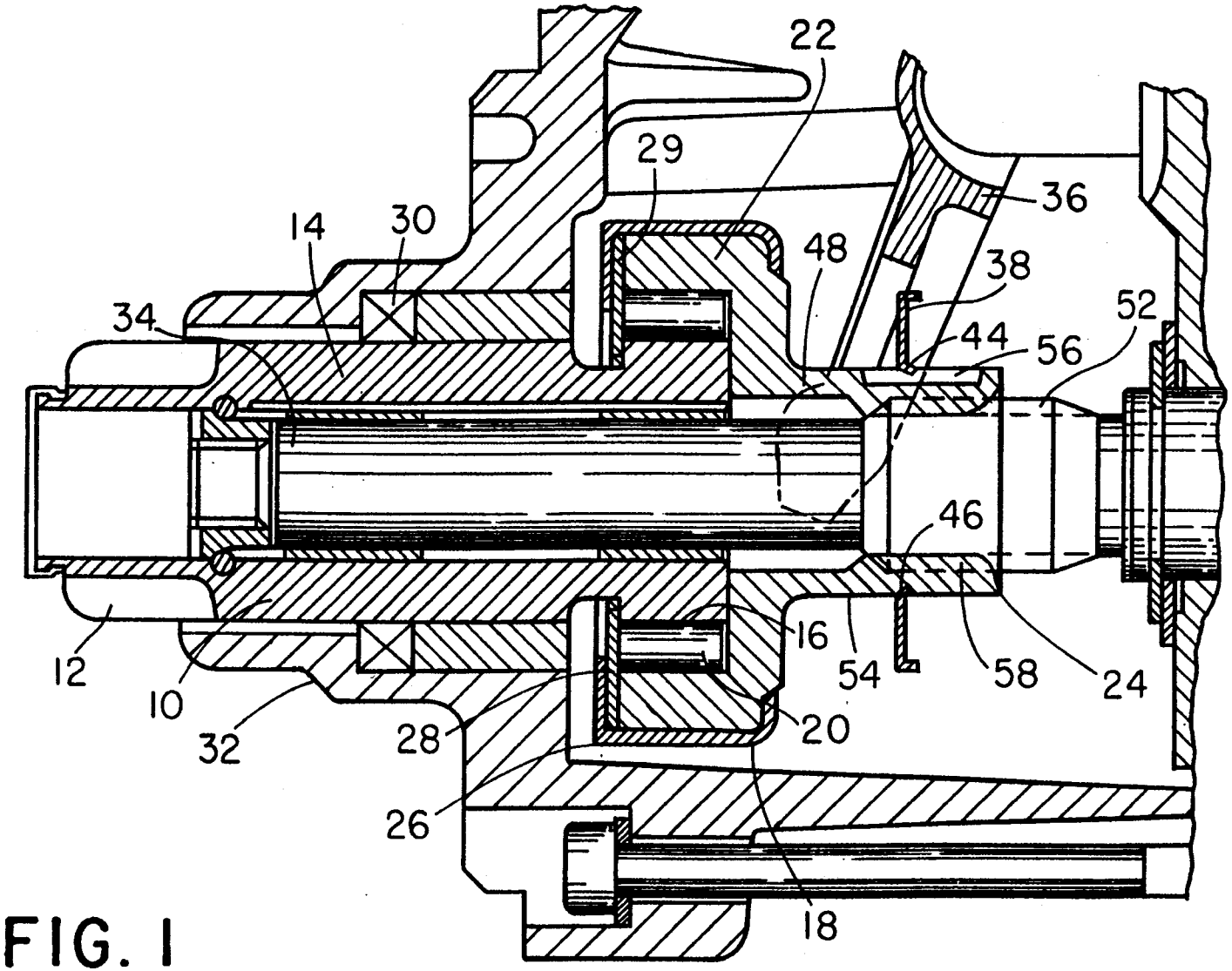
FIG. 1 is a view in cross section of part of a starter head, shown in its working position, the starter head being equipped with a return device in accordance with the invention.

With reference first to FIG. 1, a starter head comprises a starter pinion 10, one of the ends of which includes a toothed crown 12 which is arranged to mesh with a second toothed crown on the engine flywheel (not shown). The toothed crown 12 is extended by a cylindrical portion 14. The end of the cylindrical portion 14 remote from the end carrying the crown 12 defines the track 16 for a free wheel 18, which consists of a set of loaded rollers 20. In the example shown in FIG. 1, the cage of the free wheel comprises one end portion 22 of a drive sleeve 24.

A shroud 26 is press fitted over the periphery of the end portion 22, so as to secure together the starter pinion 10, the drive sleeve 24 and the free wheel 18. In the usual well known way, the shroud 26 retains in position two half rings 28 and 29, which close and seal the free wheel 18. The starter head assembly is guided in rotation by a ball bearing 30, which is housed inside an end portion 32 of the casing of the starter.

The starter head is of course mounted for sliding movement with respect to a motor shaft 34, so that it can be displaced from a rest position to the working position shown in FIG. 1, in which the starter pinon 10 meshes with the toothed crown on the flywheel, mentioned above. Displacement of the starter head between these two positions, in translational movement, is effected in the usual way by pivoting action of a lever 36.

When the engine has started, the starter head assembly must be returned to its rest position. This of course involves its movement from left to right, as seen in FIG. 1, this being effected by pivoting of the lever 36 in the clockwise direction, with the lever 36 being in engagement with a return device. This return device is secured to the starter, and more particularly to the drive sleeve 24. The return device consists of a ring member 38 which has the general form of a dish, and which will now be described in greater detail with reference to FIGS. 2 to 4.

Figure 2:
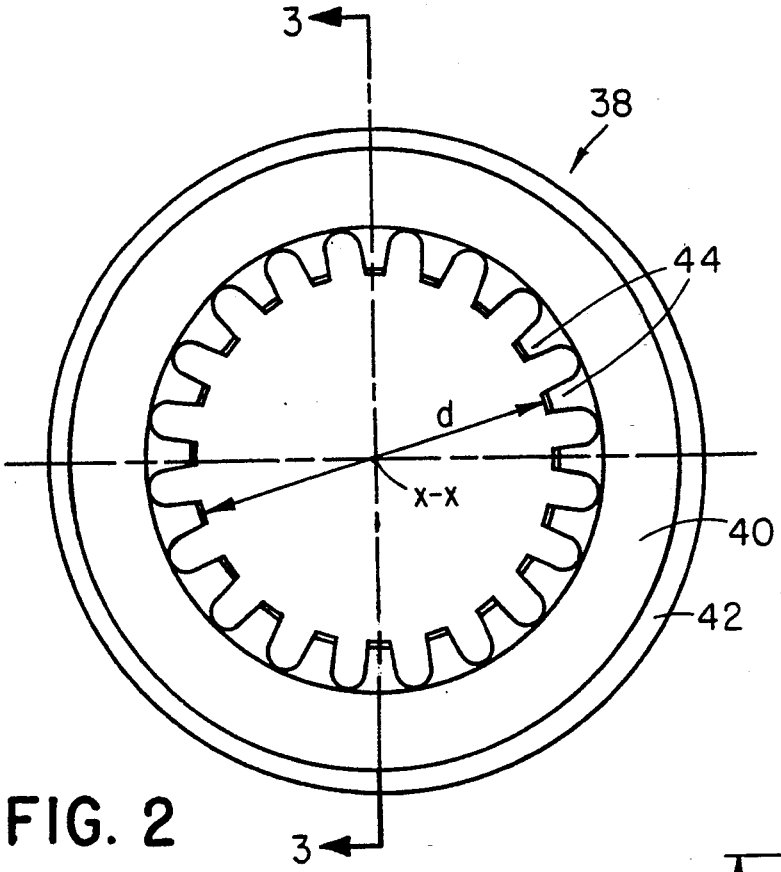
FIG. 2 is a front view on a larger scale, showing a ring member which constitutes the return device.
Figure 5:
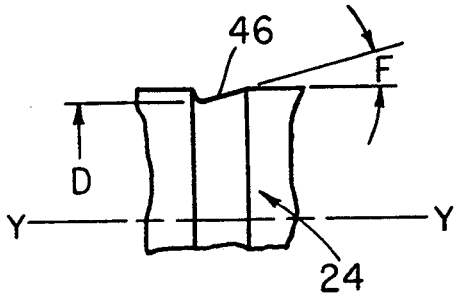
FIG. 5 is a detail view of part of the drive sleeve of the starter.
Figure 3:
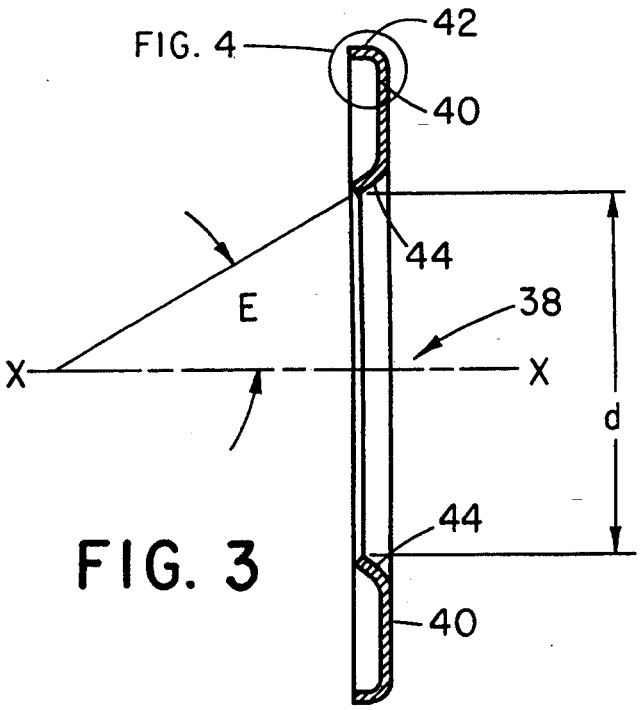
FIG. 3 is a view of the same ring, seen in cross section taken on the line 3—3 in FIG. 2.
Figure 6:
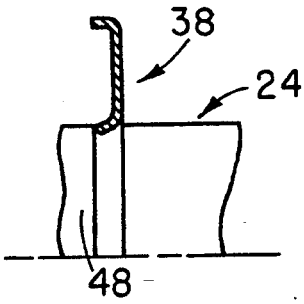
FIG. 6 is a partial view showing how the ring of FIGS. 2 and 3 is mounted on the drive sleeve of FIG. 5.

Referring therefore to these Figures, the ring member 38 has a flat circular flank portion 40, the outer periphery of which is a wall or flange 42 extending axially, i.e. at right angles to the flank portion 40, and which enhances the rigidity of the ring member 38. A set of teeth 44 is formed integrally on the inner periphery of the flank portion 40. These teeth 44, of which there are twenty in the examples shown in FIG. 2, are spaced apart uniformly and are also inclined to the axis X—X of the ring portion 38, with which they define an angle of inclination E. The teeth 44 are resiliently deformable. They are arranged to cooperate, with a snap action, in a peripheral groove 46 (see in particular FIGS. 5 and 6), which is formed on an inner end portion 48 of the drive sleeve 24. The groove 46 defines an angle of inclination F with respect to the axis Y—Y of the drive sleeve 24. The value of the angle F is smaller than that of the angle E between the teeth 44 of the ring member 38 and the axis X—X. The teeth 44 are so arranged that they have an internal diameter d which is smaller than the minimum diameter D of the annular groove 46 of the drive sleeve 24.

To assemble the return device, it is enough to introduce the ring member 38 to the end 48 of the drive sleeve 24 and then to slide it along the latter. During this movement the teeth 44 are deformed due to their own elasticity, until they snap into the annular groove 46. The fact that the groove 46 has an angle of inclination F which is smaller than the angle of inclination E of the teeth 44 means that the latter are permanently engaged in the groove 46, because they cannot recover their rest position. This engagement is further enhanced by the fact that the minimum diameter D of the groove 46 is smaller than the internal diameter d of the teeth 44. The return device constituted in this way is of particularly simple design, since it consists only of a single component, namely the ring member 38.

Due to the snap action of the teeth 44, the ring member 38 is secured against axial movement, while the engagement of the teeth 44 in the groove 46 has the effect of producing a friction torque which is large enough to prevent the ring member 38 from rotating by itself.

The angle E by which the teeth 44 are inclined to the axial direction lies between 20 and 45 degrees, and is preferably equal to 30 degrees. The angle of inclination F of the annular groove 46 is substantially equal to one half of the angle E of the teeth 44.

Figure 4:
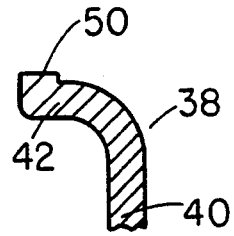
FIG. 4 is a view of a position of the same ring indicated at 4 in FIG. 3, FIG. 4 being on a larger scale still.

Referring now to FIG. 4, the flange 42 of the ring member 38 has a collar 50 formed on the outer periphery of one of its ends, with this collar 50 projecting from the flange 42. The purpose of the collar 50 is to guide the ring member 38 on the drive sleeve 24 during automatic assembly.

As can be seen in FIG. 1, the drive sleeve 24 is formed, in a bore of its inner end portion 48, with helical splines 50 which cooperate with further helical splines 52 formed on the motor shaft 34. The helical splines 50 of the drive sleeve 24 are formed by swaging. This results in helical grooves 56 being formed, in facing relationship with the splines 52, on the outer periphery 54 of the end portion 48 of the drive sleeve 24.

It is arranged that the number of teeth 44 in the ring member 38 is a multiple of the number of helical grooves 56, so that the teeth 44 are engaged in these grooves. This arrangement enables some of the teeth 44 to be in radial abutment against the grooves 56, thus providing an additional means to prevent rotation of the ring member 38.

The present invention is of course not limited to the embodiment described above and shown in the drawings, but embrace any variant within the scope of the claims that would present itself to a person skilled in the art. In particular, the return device may be located on a part of the starter head other than the drive sleeve 24, without departing from the scope of the invention.

What is claimed is:

1. A starter head for an internal combustion engine, comprising a motor shaft, a starter pinion mounted on said motor shaft for sliding movement along said shaft, a free wheel surrounding said motor shaft, and a drive sleeve surrounding said motor shaft, together with a shroud securing said starter pinion, said free wheel and said drive sleeve together, said drive sleeve having an end portion defining an outer periphery of said end portion having a groove formed in said outer periphery, the starter head further including a return device that has a ring member having an inner periphery defining a plurality of resiliently deformable teeth therein, with said teeth cooperating with said groove of the drive sleeve by snap action.

2. A starter head according to claim 1, wherein the ring member defines an axis and the teeth define a first angle of inclination with respect to the said axis.

3. A starter head according to claim 2, wherein the said first angle of inclination is in the range 20 to 45 degrees.

4. A starter head according to claim 3, wherein the said first angle of inclination is 30 degrees.

5. A starter head according to claim 2, wherein the drive sleeve defines an axis thereof and the said groove of the drive sleeve has an annular surface defining a second angle of inclination with respect to the axis of the drive sleeve, the second angle of inclination being smaller than the said first angle of inclination.

6. A starter head according to claim 5, wherein the second angle of inclination is substantially equal to one half of the first angle of inclination.

7. A starter head according to claim 1, wherein the said ring member has a flange at its outer periphery, the flange defining a collar portion projecting therefrom.

8. A starter head according to claim 1, wherein the said end portion of the drive sleeve further includes on its periphery a plurality of helical grooves, the number of teeth of the said ring member being a multiple of the number of the said helical grooves.

* * * * *